United States Patent [19]

Székely et al.

[11] Patent Number: 4,770,350

[45] Date of Patent: Sep. 13, 1988

[54] PROCESS FOR INTENSIFICATION OF GRINDING STONE COAL

[75] Inventors: Éva Székely; Róza Székely, both of Budapest, Hungary

[73] Assignee: Magyar Szénhidrogénipari Kutató-Fejlesztö Intézet, Szászhalombatta, Hungary

[21] Appl. No.: 97,414

[22] Filed: Sep. 15, 1987

Related U.S. Application Data

[63] Continuation of Ser. No. 891,398, Jul. 29, 1986, abandoned.

[30] Foreign Application Priority Data

Aug. 27, 1985 [HU] Hungary ..... 3238/85

[51] Int. Cl.[4] ..... B02C 19/12

[52] U.S. Cl. ..... 241/16; 241/18

[58] Field of Search ..... 241/1, 21, 24, 15, 16, 241/62, 18; 44/51

[56] References Cited

U.S. PATENT DOCUMENTS 3,506,200 4/1970 Raudenbush ..... 241/62 X 4,613,084 9/1986 Takamoto et al. ..... 241/16

*Primary Examiner*—Mark Rosenbaum

*Attorney, Agent, or Firm*—Schweitzer & Cornman

[57] ABSTRACT

A process for intensifying the grinding of coal by, prior to grinding, adjusting the water content of the coal to a value 0.05–2.5% by weight greater than the water content of the coal in an air-dry state.

3 Claims, 1 Drawing Sheet

PROCESS FOR INTENSIFICATION OF GRINDING STONE COAL

Figure 1:
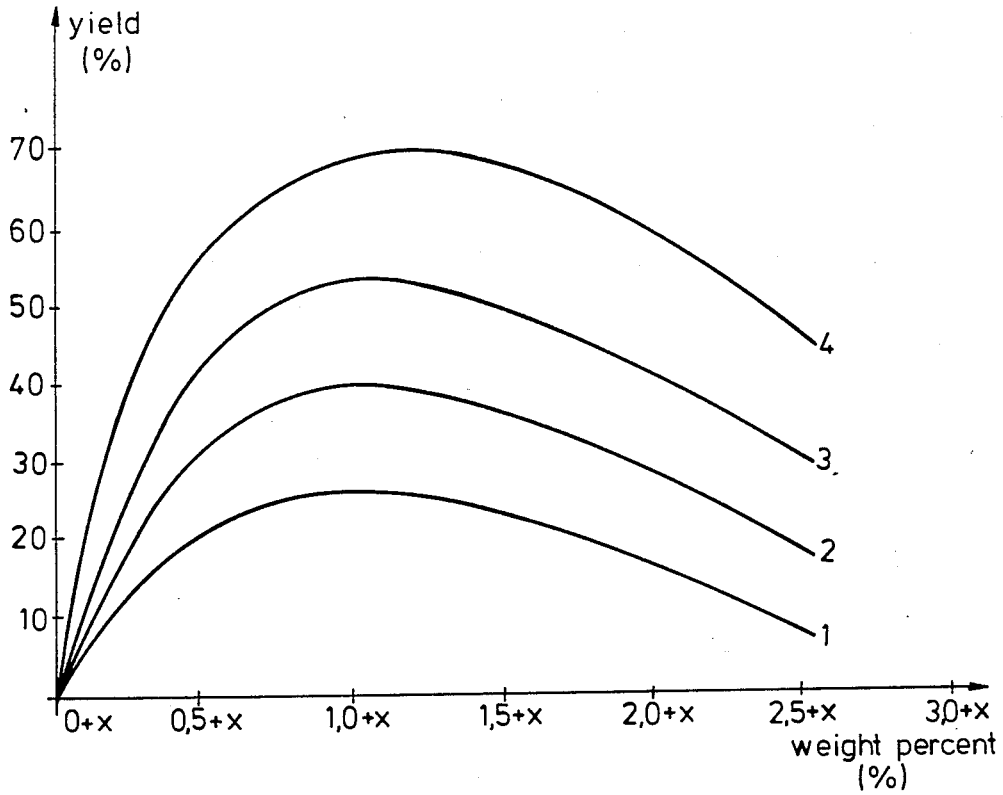

This is a file wrapper continuation of application Ser. No. 891,398, filed July 29, 1986, now abandoned.

The invention relates to a process for intensification of grinding stone coal. The process according to the present invention is carried out by adjusting the moisture content of the coal to be ground to a value of 0.05–2.5% by weight higher than that of the air-dry coal using a drying operation or by wetting coal with water-spraying.

Stone coal obtained from the mine is processed for getting the appropriate grain-size, grain-size distribution by crushing and grinding. It is known that grinding is an energy-demanding process. Specific energy requirement of grinding can be decreased by suitable additives. Application of additives is general in the field of fine grinding, which is used for example in the cement industry, production of pigments, etc. Grinding additives contacted with the surface of material to be ground are usually surface active agents dissolved in water. In the process known from Hungarian Pat. No. 155.524 a phosphate compound containing organic nitrogen is used as grinding additive amounting to 0.001–1% by weight of the material to be ground. The use of the above additive results in a 17 percent surplus in the finer fraction of milled limestone fluor. According to the same patent specification an increase of 50 percent in the milling capacity is achieved by adding urea-sesquiphosphate-triethanolamide for milling cement clinker.

In the DE-PS Pat. No. 2,251,935 the use of aliphatic acetates as milling additive is suggested for the dry milling of minerals, particularly of pigments and fillers.

Processes disclosed in above patents take advantage of the fact that adsorption of a surface active agent decreases surface energy of the solid and therefore stability of the solid and its resistance to mechanical effects also decreases.

Thus, it is known that, by using grinding additives, the efficiency of the grinding process can be improved significantly.

Advantages of applying grinding additives include the following:

appropriate grain-size and grain-size distribution can be achieved with energy savings, efficiency of grinding improves, efficiency and capacity of the milling equipment is enhanced.

In order to obtain appropriate grain size mineral carbon before burning, for example in boilers fed by powder coal, is disintegrated in a ball mill. Moisture content of the coal depending on its origin (separated by flotation after mining, obtained from gangue) is between 5 and 30% by weight. For keeping heating value constant and to hinder aggregation and sticking up in the grinding process the coal before feeding into the coal mill is dried in counter-flow of hot smoke gases at about 400° C. to a water content of 0% by weight.

Processes for enhancing efficiency of grinding black stone coal has not been known from the prior art.

The aim of our invention is to improve grinding process of stone coal, i.e. to increase grinding efficiency and/or capacity under unchanged grinding conditions.

Our invention is based on the experience, that the surface of stone coal and accompanying minerals is of heterogeneous polarity, consequently it can be wetted by water.

We have recognized, that wetting the surface of the coal with water, results in savings of grinding energy. Furthermore we have found, that savings in energy passes through a maximum in the function of moisture content.

Optimum amount of water to be applied depends on porosity, pore-size distribution, surface roughness of the particles, surface inhomogeneity, hydrophobic-hydrophyllic character of the surface and mineral composition.

Maximum savings of energy can be achieved if, before drying, moisture content of the coal is adjusted to a level which is 0.5–2.5% by weight higher than the water content in the air-dry state. Required water content is obtained by controlled drying of wet coal (by decreasing temperature and/or flow rate of smoke gas used for drying) or by wetting coal if necessary.

According to our process, the starting moisture content of coal fed into the ball mill corresponds to a water content required to fill up all the pores of particles. Furthermore, the water content has to be enough to form an adhered water layer on the surface of the coal grains. However, the amount of water is not enough to develop liquid bridges between the particles.

The role of water in increasing grinding intensity is summarized as follows:

surface energy of wetted solid surface is smaller than that of dry solid surface.

sticking to surfaces of grinding unit and agglomeration of particles is hindered by the interparticle layer of water adhered.

while grinding a part of grinding energy is accumulated into the material to be ground and mechanochemical reactions become possible. When pores are filled with water part of grinding energy accumulates in water. Expansion accompanying water-steam phase transition results in cleavage or blowing up of solid particles (disintegration process).

EXAMPLE 1

Stone coal from transdanubian origin is milled in a laboratory ball mill of 970 $cm^3$ volume. Filling factor in the experiment is 28 percent. Measurements were carried out at different RPM values, coal to ball (milling body) mass ratios in the mill and at different moisture contents. In each experiment milling time was 60 min. Surplus yield as a function of moisture content is shown in FIG. 1.

Water content of the air-dry sample is denoted with X.

Data related to FIG. 1, curves 1–4 are given as follows:

| Curve | Coal to milling body (mass ratio) | n (rpm) |
|---|---|---|
| 1 | 1:1 | $n_{opt}$*/2 |
| 2 | 1:1 | $n_{opt}$ |
| 3 | 1:3 | $n_{opt}/2$ |
| 4 | 1:3 | $n_{opt}$ |

*$n_{opt}$ = the optimum of RPM
Milling time = 60 min

FIG. 1 demonstrates clearly, that maximum yield is achieved when moisture content of the coal is increased to a value of 1% by weight higher than that of the air-dry coal.

What we claim is:

1. A process for intensifying grinding of stone coal comprising;

(a) ascertaining the water content of said stone coal in a air-dry state, (b) adjusting the water content of said stone coal to a value of 0.05–2.5% by weight greater than that of said stone coal in an air-dry state, and (c) grinding said stone coal after adjusting its water content to the desired value.

2. A process according to claim 1, further characterized by (a) adjusting the water content of the coal by drying or water spraying, as required.

3. A process according to claim 1, further characterized by the water content of the coal, after adjustment, being such that (a) the pores of the coal particles are filled with water, (b) an adhered water layer is formed on the surface of the particles, and (c) the amount of water is insufficient to form liquid bridges between the particles.

* * * * *